US005344156A

United States Patent [19]

Levin

[11] Patent Number: 5,344,156

[45] Date of Patent: Sep. 6, 1994

[54] ACTION GAME

[76] Inventor: John M. Levin, 412 Fairview Rd., Penn Valley, Pa. 19072

[21] Appl. No.: 970,355

[22] Filed: Nov. 2, 1992

[51] Int. Cl.[5] ..... A63F 9/02

[52] U.S. Cl. ..... 273/355; 273/356; 273/350

[58] Field of Search ..... 273/355-357, 273/350, 351, 353, 349; 446/161

[56] References Cited

U.S. PATENT DOCUMENTS

| | | | |
|---|---|---|---|
| 310,388 | 1/1885 | Dealy | 273/355 |
| 1,551,899 | 9/1925 | Michener . | |
| 1,559,140 | 10/1925 | Wolkenhauer . | |
| 1,924,261 | 8/1933 | Thompson . | |
| 2,299,551 | 10/1942 | McGahey | 446/161 |
| 2,747,874 | 5/1956 | Cappella, Jr. . | |
| 2,859,037 | 11/1958 | Howard | 273/355 |
| 3,434,716 | 3/1969 | Schwartz | 273/350 |
| 3,559,989 | 2/1971 | Breslow | 273/450 |
| 3,895,801 | 7/1975 | Baird . | |
| 4,077,629 | 3/1978 | Chestney | 273/349 |
| 4,145,049 | 3/1979 | Papazian, Sr. . | |
| 4,223,894 | 9/1989 | Fabricant | 273/349 |

*Primary Examiner*—Mark S. Graham
*Attorney, Agent, or Firm*—Caesar, Rivise, Bernstein, Cohen & Pokotilow, Ltd.

[57] ABSTRACT

An action game comprising a reservoir capable of holding a quantity of a material such as a liquid therein. A member for propelling a projectile, such as a catapult, is fixedly secured or swivably connected adjacent the reservoir, preferably one catapult or member being located at each end of the reservoir. One or more players directs a plurality of the projectiles using the catapult to a floatable object (e.g., boat-shaped) which floats on the material within the reservoir to try to sink the object in a competitive fashion. The floatable object includes a compartment to hold projectiles, so that the object can be submerged (i.e., sunk) in the material when a sufficient number of the projectiles is contained in the compartment. Each player can try to sink his or her opponent's floating object before his or her own floating object is sunk, or each player can compete by themselves against the clock.

9 Claims, 2 Drawing Sheets

ACTION GAME

BACKGROUND OF THE INVENTION

In games of skill and entertainment, as well as educational games, it is desirable that the games include features which simulate real life conditions. Games which involve and stimulate player action and involvement are a popular medium of entertainment requiring skill and quick observations. These types of games utilize the eye, the hand and the mind to develop quick perception and instant response to particular situations.

Games involving floating objects such as boats or vessels have always been a popular form of entertainment as many persons are fascinated with boating and the skill of the maneuvering involved. In addition, many individuals are also fascinated with the strategy and competitiveness involved in a naval operation utilizing various types of floating vessels.

Several patents, including U.S. Pat. No. 4,223,894 (Fabricant); U.S. Pat. No. 3,895,801 (Baird); and U.S. Pat. No. 1,551,899 (Michener) disclose games in which the players direct streams of water against targets or onto vessels in order to sink them.

Other patents disclose games in which bombs or projectiles are directed against vessels which cause the vessels to collapse or fall apart when properly struck, and include U.S. Pat. No. 1,559,140 (Wolkenhauer), U.S. Pat. No. 2,747,874 (Cappella, Jr. et al.), U.S. Pat. No. 3,434,716 (Schwartz) and U.S. Pat. No. 4,145,049 (Papazian).

U.S. Pat. No. 1,924,261 (Thompson) discloses a game in which detonation occurs if a vessel is properly struck with a bomb from an airplane.

In addition, U.S. Pat. No. 2,859,037 (Howard) discloses a game apparatus simulating a boat invasion which utilizes self-propelled floating vessels to maneuver and complete a pre-established course. The vessels may be hit by pellets which are propelled by a spring actuated plunger device to divert the path of the vessel from the finish line.

In view of the high degree of interest in boat-related games, a need and desire for new games involving boats or other floating objects is believed to exist.

OBJECTS OF THE INVENTION

Accordingly, it is a general object of this invention to provide an action game which is exciting to play.

It is a more specific object of this invention to provide an action game which requires skill, coordination and quick responses and, which permits the player(s) to demonstrate success based upon personal skill.

It is a further object of this invention to provide an action game which can be used competitively by one or more players.

It is yet another object of this invention to provide a simple, material-based game which tests a participant's ability to accurately direct projectiles to a designated target.

It is a further object of this invention to provide an economical game which is simple to make and easy to play with, at a low cost.

SUMMARY OF THE INVENTION

These and other objects of this invention are achieved by providing a game comprising a reservoir capable of holding a quantity of a material (preferably a liquid, such as water) therein. A member for propelling a projectile, such as a catapult, is fixedly secured or swivably connected adjacent the reservoir, preferably one catapult or member being located at each end of the reservoir. One or more players utilize the catapult to direct a plurality of the projectiles onto a floating object such as a toy boat or ship, in the reservoir, to try to sink the object in a competitive fashion. The floating object preferably is a replication of a boat or ship having a compartment to hold projectiles, so that the object can be submerged (i.e., sunk) in the material within the reservoir when a sufficient number of projectiles is propelled in the compartment of the object. Each player can try to sink its opponent's boat or ship before its own boat or ship is sunk. Alternatively, the players can compete by themselves against the clock.

DESCRIPTION OF THE DRAWING

Other objects and many attendant features of this invention will become readily appreciated as the same becomes better understood by reference to the following detailed description when considered in connection with the accompanying drawing wherein.

DETAILED DESCRIPTION OF THE PREFERRED EMBODIMENTS

Figure 1:
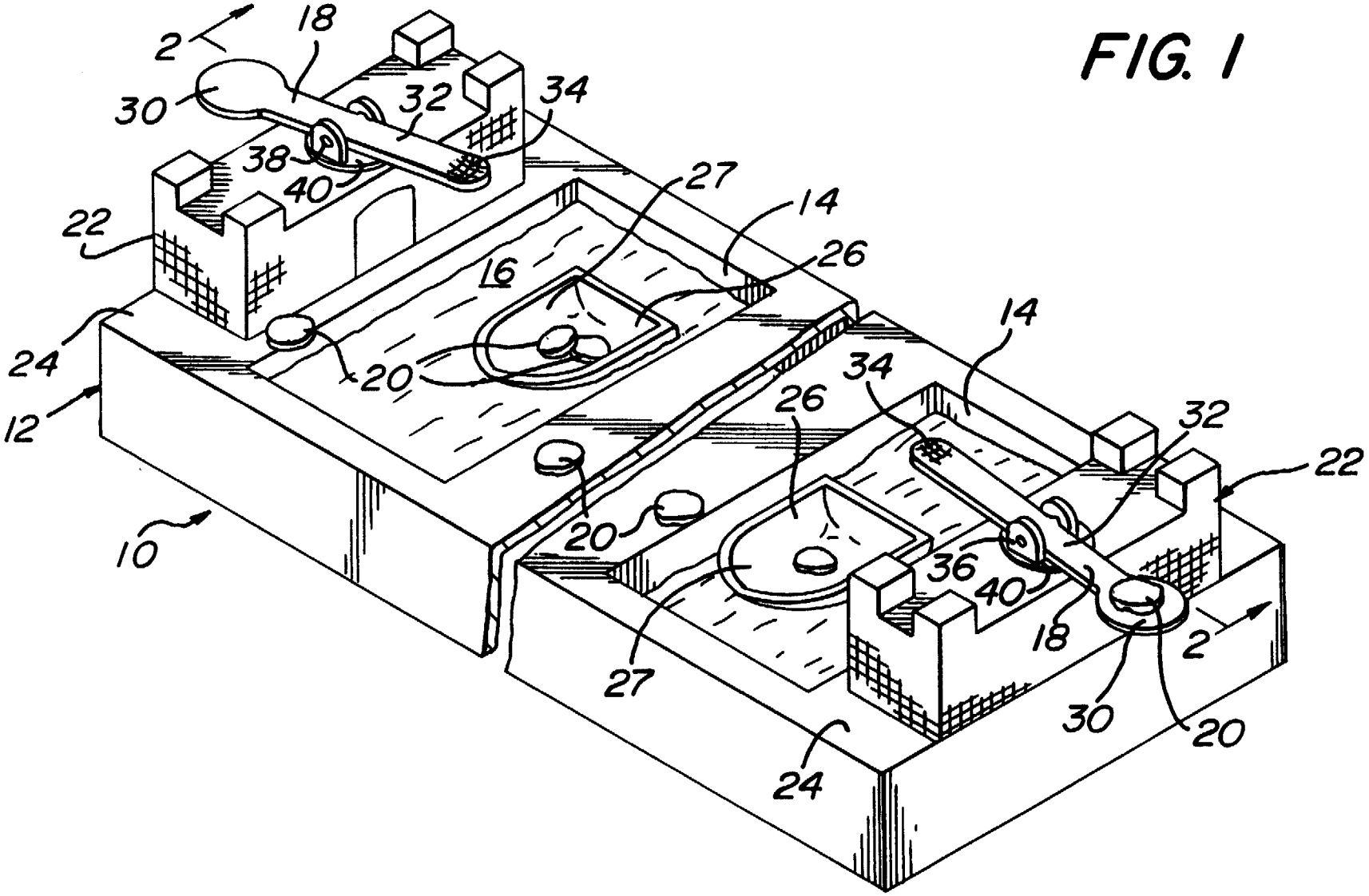
FIG. 1 is a fragmentary isometric view of one embodiment of the action game of the present invention.

Referring now to various figures of the drawing where like reference numerals refer to like parts, there is shown at 10 in FIG. 1, an action game constructed in accordance with the preferred embodiment of this invention. The game 10 basically includes a platform 12 with a pair of reservoirs 14 therein. Each reservoir 14 is capable of holding a quantity of a liquid 16 to a predetermined depth.

A propelling member 18 for propelling a projectile 20 therefrom can be fixedly secured or swivably connected adjacent the reservoirs 14. As is shown, the members 18, e.g., catapult, are swivably mounted on raised supports 22 located at the opposite ends of the platform 12, adjacent respective reservoirs 14, so that two players can play simultaneously. The raised supports 22 can be bonded or secured in any other manner to the upper surface 24 of the platform 12, and preferably is in the shape and configuration of a castle as shown. The propelling members 18, in the form of catapults, are fixedly or rotatably secured to the upper wall of the castle. Elevating the propelling members 18 above the upper surface of the reservoirs 14 therein, provides the players with a sufficient trajectory range to permit projectiles 20 to hit the opponent's boat 26 (when the game is played by two players) when the boat is floated on the liquid 16 within the most remote reservoir 14.

One object of the game is to permit two players to simultaneously shoot projectiles 20 at their opponent's boat. Each opponent's boat in the reservoir 14 is located furthest from the other player's own propelling member 18 The winner is the first player to sink his or her opponent's boat, by projecting a sufficient number of projectiles 20 (e.g., six) into the opponent's boat 26 to cause that boat to sink.

Figure 2:
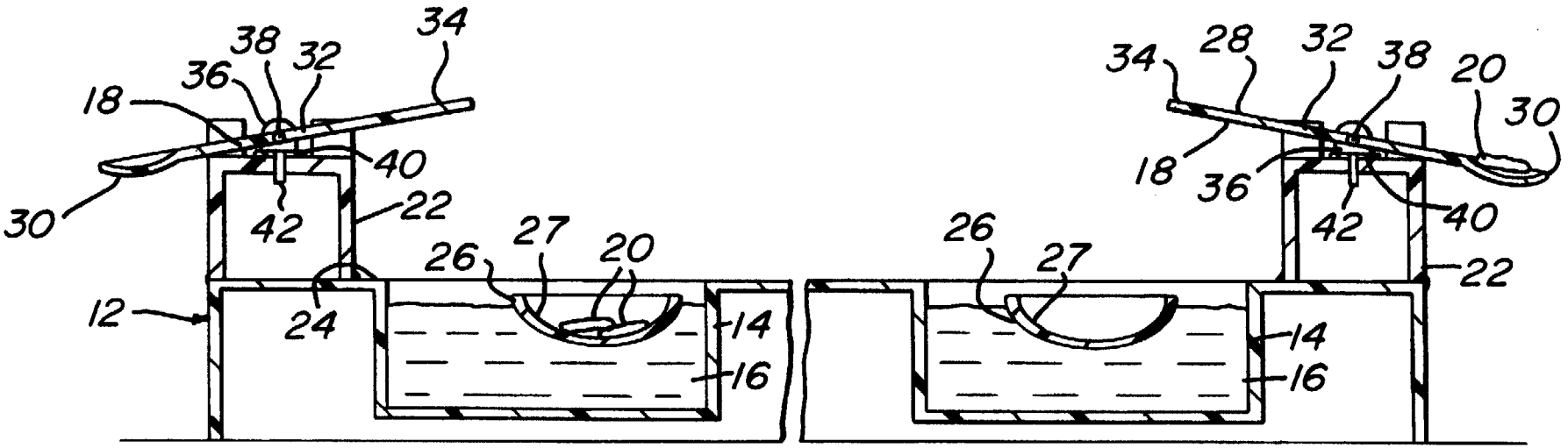
FIG. 2 is a fragmentary, sectional view of the action game shown in FIG. 1, taken along line 2—2.

Instead of having two separate reservoirs 14 as shown in FIGS. 1 and 2, a single, larger reservoir (not shown) may be used to float the player's boats 26. The reservoir(s) 14 of the present invention may be integrally molded or formed as a unitary part of platform 12, as is shown in the drawing, or alternatively may be formed as separate compartment(s) or container(s) having a peripheral flange about the upper edge thereof which is/are received within properly sized openings in the upper wall of the platform. The platform 12 and reservoirs 14 can be formed of any desired material, such as plastic, metal, etc. Preferably, the material which is employed is a moldable plastic which permits the game to be constructed as an inexpensive, lightweight article.

In addition, the number and types of propelling members 18 which can be used, as well as the location thereof, can be varied depending upon the circumstances of use. As illustrated, the propelling members 18 shown in FIGS. 1 and 2, are typical catapults, each comprising an elongated member 28 having a projectile holding portion 30, a central pivoting portion 32 and an actuating portion 34. The projectile holding portion 30 may be of almost any suitable shape and size depending upon the shape and size of the projectile to be propelled thereby. As shown in FIG. 2, the central pivoting portion 32 is pivotally secured to opposed supports 36 by pin 38 which may pass through, or be secured to, elongated member 28. When it is desired to propel a projectile 20, the projectile is placed on the projectile holding portion 30 and the player then depresses the actuating portion 34 by utilizing his or her finger, or by other means. The downward motion on the actuating portion 34 causes the elongated member 28 to pivot about the pin 38, to propel the projectile 20 towards the target, e.g., the opponent's boat 26.

If desired, the catapult may be stationary, or rotatably mounted (swivably connected) via the circular rotating base 40 which is rotatably secured to the upper wall of the castle 24, by a pin 42 or other suitable means. The swivel action of each catapult enables the line of its trajectory to be changed, in the event the boat to be sunk, moves out of the initial trajectory line of the catapult.

The boat 26 has an interior compartment 27 for receiving a plurality of projectiles 20 therein, so that the boat can be submerged or sunk in the liquid, e.g., water, when a sufficient number of the projectiles is received within the compartment 27. The boat 26 preferably is formed of a lightweight, durable material, such as a floatable rubber or plastic. The shape and size of the boats 26 can be varied depending on a number of factors, such as the size of the reservoir(s) 14 and the number and size of the projectiles 20 which are utilized.

In one embodiment of the present invention, the two reservoirs may be 6 inches wide by 10 inches long, and have a depth of 3 inches. In this embodiment the boat can be approximately 3 inches wide at its rear end, with a longitudinal length of approximately 4 inches. Preferably, the projectiles 20 are a closed container having a material therein, such as in the form of a small bean bag, which are weighted such that five to six projectiles will sink the boats 26 within the reservoir(s) 14.

It is within the scope of this invention to employ other types of projectiles with the catapults, e.g., sand bags, rocks, plastic objects, etc.

It is also within the scope of the invention to utilize propelling members other than catapults, e.g., small, plunger-oriented cannons, bows, etc. (not shown). Of course, the type of projectile which is utilized needs to be designed so that it is capable of being projected by the particular propelling member which is used.

In a preferred form of playing the action game of the present invention, each player directs a plurality of the projectiles 20, using his or her catapult 18, to his or her opponent's boat 26. The boat 26 of each player floats in the liquid 16 within the reservoir 14, most remote from that player's catapult 18, i.e., the reservoir closest to the opponent's catapult, to try to sink the boat 26 in a competitive fashion. The object of the game is for each player to sink his or her opponent's boat before his or her own boat is sunk; by projecting a sufficient number of projectiles into the opponent's boat to sink it.

The game also can be played in a variety of other ways. For example, each player can take a turn in sinking a boat 26 in one of the reservoirs 14, with the player accomplishing that feat in the shortest time or with the fewest attempts being the winner.

It is also within the scope of the invention that the floating object or boat 26 can take on various sizes, shapes and configurations. Moreover, it is not necessary that each player have an similarly shaped boat and different boats can be utilized simultaneously.

Moreover, it is envisioned that materials other than a liquid 16 can be included in the reservoir(s) 14, provided that the floating object or boat 26 is capable of normally floating in the material, and also being sunk within the material when a sufficient number of projectiles are directed onto or into the floating object.

All of the elements of the present invention may be comprised of a wide variety of materials. In order to minimize manufacturing costs and to make the action game lightweight and easily transportable. Typical types of plastics, rubbers and metals known in the industry would be generally acceptable.

Without further elaboration the foregoing will so fully illustrate my invention that others may, by applying current or future knowledge, adapt the same for use under various conditions of service.

I claim:

1. An action game comprising:

(a) a reservoir means for holding a quantity of a material therein;

(b) a plurality of projectiles;

(c) a floatable object which floats on the material within the reservoir means, the object comprising a compartment for holding a sufficient number of the projectiles for submerging the object in the material; and (d) means for propelling at least one of the projectiles toward the reservoir, wherein the material is liquid, and wherein the reservoir means comprises two reservoirs located adjacent one another, each of the two reservoirs being capable of holding at least one of the floatable objects.

2. The game of claim 1 wherein the means for propelling the projectile comprises a catapult.

3. The game of claim 2 wherein the catapult is fixed adjacent the reservoir means.

4. The game of claim 2 wherein the catapult is swivably mounted adjacent the reservoir means.

5. The game of claim 1 wherein the means for propelling the projectile is fixed adjacent the reservoir means.

6. The game of claim 5 wherein the means for propelling the projectile is a catapult.

7. The game of claim 1 wherein the reservoir means comprises a first end and a second end and the means for propelling a projectile comprises a catapult located adjacent each of the first and second ends of the reservoir means.

8. The game of claim 7 wherein the discrete weighted object comprises a closed container filled with a material.

9. The game of claim 8 wherein the material is selected from the group consisting of sand, beans and plastic.

* * * * *